US005339748A

United States Patent [19]

Bilotti

[11] Patent Number: 5,339,748

[45] Date of Patent: Aug. 23, 1994

[54] TABLE COVER

[75] Inventor: Alfred J. Bilotti, Huntington Beach, Calif.

[73] Assignee: Dayva International, Inc., Huntington Beach, Calif.

[21] Appl. No.: 103,299

[22] Filed: Aug. 9, 1993

[51] Int. Cl.[5] ..... A47C 27/00

[52] U.S. Cl. ..... 108/90; 297/228.11

[58] Field of Search ..... 108/90; 297/228.11, 297/228.12; 150/158, 154; 5/495, 497

[56] References Cited

U.S. PATENT DOCUMENTS

| | | | |
|---|---|---|---|
| 1,219,790 | 3/1917 | Taylor | 108/90 |
| 1,996,575 | 4/1935 | Fry et al. | 297/228.11 |
| 2,161,448 | 6/1939 | Bishop | 297/228.11 |
| 2,463,223 | 9/1949 | Moss | 297/228.11 |
| 3,003,816 | 10/1961 | Wilson | 297/228.11 |
| 4,709,019 | 12/1988 | Sweetser et al. | 108/90 |
| 5,020,177 | 6/1991 | Etherington | 5/496 |

FOREIGN PATENT DOCUMENTS

| | | | |
|---|---|---|---|
| 400894 | 8/1924 | Fed. Rep. of Germany | 5/497 |

*Primary Examiner*—Jose V. Chen

*Attorney, Agent, or Firm*—Raymond Sun

[57] ABSTRACT

A table cover for use in covering a table top, the table cover comprising a panel having a sleeve provided along its peripheral edge, the sleeve having an exposed section and a first opening and a second opening about the exposed section. A drawstring is held within the sleeve and has a first end extending from the first opening and a second end extending from the second opening. A tongue is coupled to the panel about the exposed section of the sleeve between the first opening and the second opening, with the tongue having a loop provided therethrough. The first end of the drawstring passes through the loop in a first direction and the second end of the drawstring passes through the loop in a second direction opposite the first direction to secure a taut fit of the table cover to the table top.

8 Claims, 2 Drawing Sheets

TABLE COVER

BACKGROUND OF THE INVENTION

1. Field of the Invention

The present invention relates to table covers, and in particular, to a table cover that may be adapted for use with table tops of different sizes.

2. Description of the Related Art

Table covers are used to protect and to cover the table tops of tables. Many of the known table covers are typically made in different sizes to fit table tops of different sizes. For example, conventional circular table tops have diameters of 36 inches, 40 inches, 42 inches, 48 inches, 54 inches, and 60 inches. Therefore, a particular model of a table cover would have to be marketed and sold in six different sizes to accommodate all the conventional table top sizes on the market. The same applies to oval table tops of different sizes. Production and sale of a table cover with six different sizes therefore can be expensive and troublesome.

Such conventional table covers suffer from another drawback. Such table covers are typically provided with an elastic secured along the peripheral edges of the table cover. In use, the elastic is stretched and the table cover placed over the table top. When the elastic is allowed to contract to its original shape, the table cover conforms to the table top to provide a relatively tight fit to secure the table cover to the table top. No further means are provided to tightly fit the table cover over the table top. However, due to the fact that the conventional table covers are not custom-designed for a given table top, creases and other wrinkles may appear on the table cover. Such creases and wrinkles are aesthetically displeasing and do not provide stable support for lightweight items placed on the table top.

Therefore, there is a continuing need to provide a table cover that can accommodate a variety of different sizes of table tops, is easy to use, provides a tight-fit of the table cover to the table top to minimize creases and wrinkles, and is relatively inexpensive to manufacture.

SUMMARY OF THE INVENTION

The objects of the present invention may be achieved by providing a table cover for use in covering a table top, the table cover comprising a panel having a sleeve provided along its peripheral edge, the sleeve having an exposed section and a first opening and a second opening about the exposed section. A drawstring is held within the sleeve and has a first end extending from the first opening and a second end extending from the second opening. A tongue is coupled to the panel about the exposed section of the sleeve between the first opening and the second opening, with the tongue having a loop provided therethrough. The first end of the drawstring passes through the loop in a first direction and the second end of the drawstring passes through the loop in a second direction opposite the first direction to secure a taut fit of the table cover to the table top.

The present invention also provides a method for covering the table top of a table, in which is provided a table cover comprising a panel having a sleeve provided along the peripheral edge thereof, the sleeve having an exposed section and a first opening and a second opening about the exposed section. The table cover further comprises a drawstring retained within the sleeve and having a first end extending from the first opening and a second end extending from the second opening. A tongue is coupled to the panel about the exposed section of the sleeve between the first opening and the second opening, the tongue having a loop provided therethrough. The first end of the drawstring is then passed through the loop in a first direction, and the second end of the drawstring is passed through the loop in a second direction opposite the first direction. The first end and the second end of the drawstring are simultaneously pulled to conform the panel to the table top. Finally, the first end and the second end of the drawstring are tied to secure the table cover to the table top.

The table cover of the present invention provides a table cover that can be used with table tops of different sizes. This table cover is also easy to use, is more durable, and provides a tight-fit of the table cover to the table top to minimize creases and wrinkles. Production costs are reduced since one size can fit a number of different sizes of table tops. Furthermore, an elastic becomes optional to the table cover of the present invention since the drawstring provides a tighter and more effective wrap.

DESCRIPTION OF THE PREFERRED EMBODIMENTS

Figure 1:
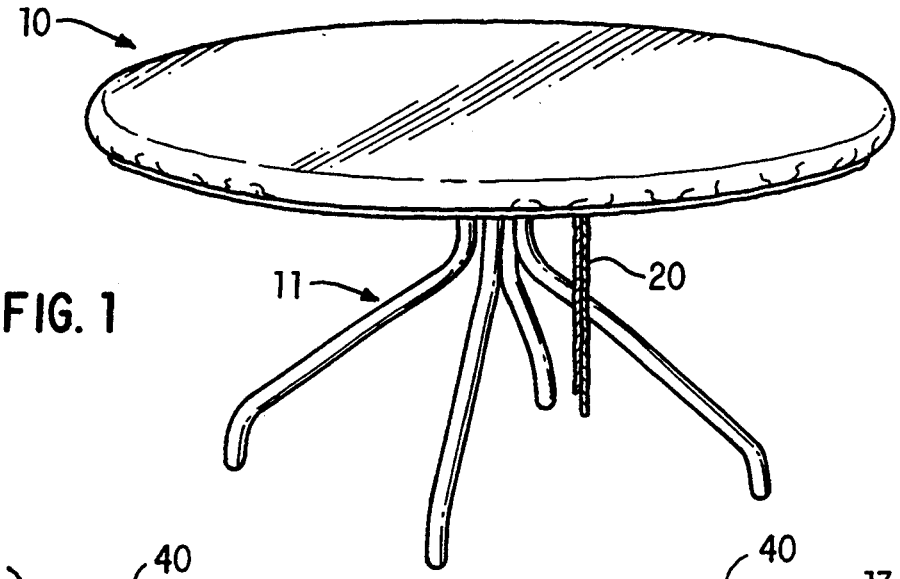
FIG. 1 is a perspective view of a table cover according to an exemplary embodiment of the present invention shown in use on a table top.
Figure 2:
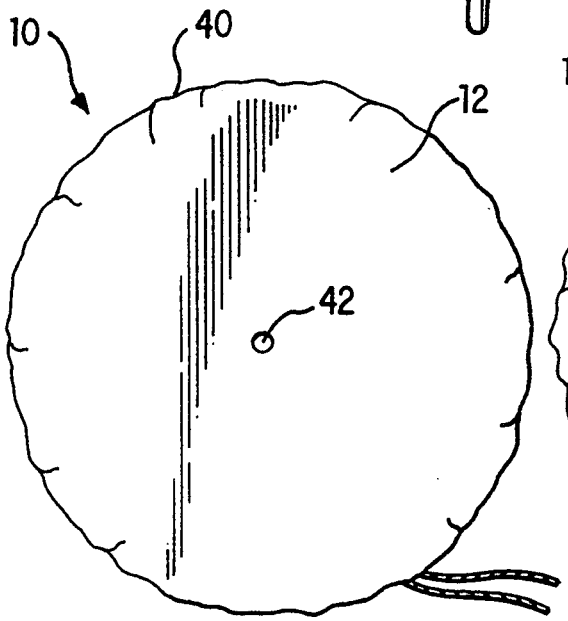
FIG. 2 is a top plan view of the table cover of FIG. 1.
Figure 3:
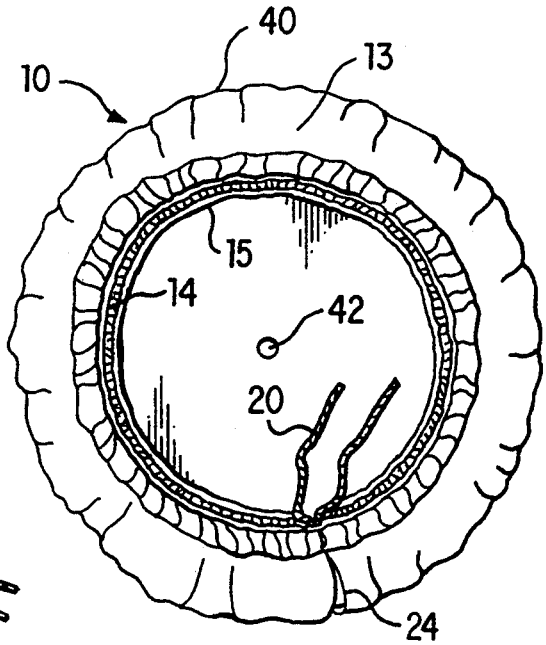
FIG. 3 is a bottom plan view of the table cover of FIG. 2.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 1–4, a table cover 10 according to an exemplary embodiment of the present invention is shown draped over and secured to the table top of a table 11. The table cover 10 comprises a panel 12 cut in the shape of a circle and surrounded by an annular flange 13 along its periphery 40. The flange 13 is preferably made of the same material as the panel 12 and may be a natural extension of the panel 12 or may be stitched to the outer periphery 40 of the panel 12 so that the flange 13 appears to be a natural extension of the panel 12. An elastic 14 is stitched or otherwise affixed along the outermost peripheral edge 15 of the flange 13. An annular sleeve 18 is provided adjacent the peripheral edge 15 of the flange 13 slightly offset from the elastic 14.

The panel 12 may be any kind of canvas, fabric or sewable material, and is preferably made of a tough flexible material such as vinyl, cotton, canvas, acrylic or plastic. The top of the panel 12 may be decorated with a pattern and colors, and may also be coated with a protective covering such as water proofing or scotchguarding. The underside of the panel 12 may be provided with a soft cloth-like material such as foam or felt to protect the table top.

It will be appreciated that the elastic 14 is not necessary and the panel 12 and/or flange 13 can be provided without the elastic 14.

Figure 4:
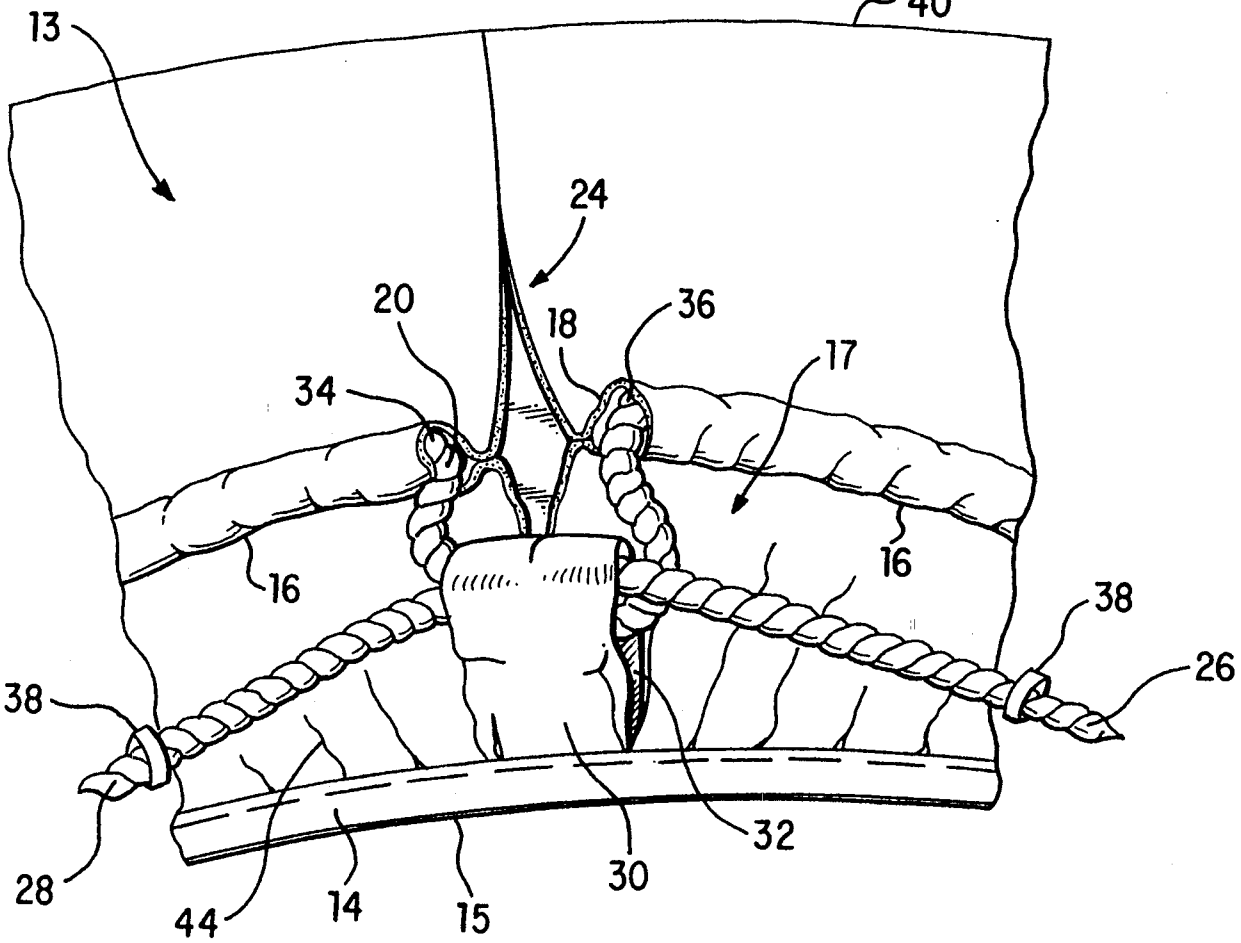
FIG. 4 is a side plan view of the drawstring connection of the table cover of FIG. 2.

The sleeve 18 retains a drawstring 20 which is used to secure the table cover 10 to the table top. The sleeve 18 may be formed by any conventional means. For example, in a preferred embodiment shown in FIG. 4, the peripheral edge 15 of the flange 13 is folded over and stitched along stitch lines 16 to form the sleeve 18. The resulting inner portion 17 of the flange 13 is then pulled downwardly and the elastic 14 affixed to the peripheral edge 15 and pulled downwardly as shown in FIG. 4. In another preferred embodiment, the peripheral edge 15 may be provided without the elastic 14, so that flange 13 may be merely folded over and then stitched to form the sleeve 18. In yet another preferred embodiment, a piece of cloth may be folded and stitched to the flange 13 to form the sleeve 18. Other ways of forming the sleeve 18 can be used without departing from the spirit and scope of the present invention.

Referring more particularly to FIG. 4, the flange 13 does not extend throughout the entire circumferential periphery 15 of the panel 12. A section 24 of the flange 13 is cut and exposed, so that the sleeve 18 has opposite open ends 34 and 36 to allow the opposite ends 26 and 28 of the drawstring 20 to extend therefrom. A tongue 30 is connected to the elastic 14 at the peripheral edge 15 at the section 24 with a loop 32 provided in the tongue. A first end 26 of the drawstring 20 extending from a first opening 34 of the sleeve 18 is passed through the loop 32. A second end 28 of the drawstring 20 extending from a second opening 36 of the sleeve 18 is also passed through the loop 32, but in a direction opposite to that of the first end 26. Thus, the ends 26 and 28 of the drawstring 20 are "crossed" at the tongue 30. Any conventional stopper 38 may be provided at the ends 26 and 28 to prevent the ends 26 and 28 from slipping backwards across the loop 32.

Alternatively, the flange 13 need not be cut at section 24. However, the sleeve 18 must not be wrapped completely around the flange 13 to allow openings 34 and 36 to exist to accommodate the opposing ends 26 and 28 of the drawstring 20.

In operation, the drawstring 20 is held loosely within the sleeve 18 so that the peripheral edge 15 can be spread out flat. The table cover 10 is then draped over a table top. The elastic 14, where it is provided, conforms the table cover 10 to the table top but only provides a relatively snug fit if the table top is of the same size as the table cover 10. Both ends 26 and 28 of the drawstring 20 are then simultaneously pulled to cause the peripheral edges 15 to wrap securely around the table top. Further pulling of the ends 26 and 28 tautly will result in the panel 12 and its flange 13 stretching towards the peripheral edges 15 to secure a tighter wrap and to eliminate any creases and wrinkles in the panel 12 covering the table top. The ends 26 and 28 can then be tied to obtain a tight wrap. At this tied position, the flange 13 will be wrinkled such as that shown by numeral 44 in FIG. 4 due to the tight wrap of the drawstring 20, but the flange 13 is disposed under the table top and not readily visible.

The tongue 30 and the "crossed" ends 26 and 28 serve an important purpose in protecting the sleeve 18 at the openings 34 and 36. If the tongue 30 is not provided, repeated pulling of the ends 26 and 28 will cause the seams of the sleeve 18 at the openings 34 and 36 to experience a significant amount of friction, and could result in the tearing of the seams at those locations. "Crossing" the ends 26 and 28 through the loop 32 of the tongue 30 relieves much of the pressure on the seams at the openings 34 and 36 and provides for a more durable table cover 10.

The drawstring 20 may be made from any durable material such as cotton, nylon, vinyl or plastic. The tongue 30 is preferably made from a flexible and sewable material, and is preferably made of the same material as the panel 12.

The table cover 10 of the present invention provides a table cover 10 that can be used with table tops of different sizes. For instance, a table cover 10 can have a diameter adapted for use with a 60-inch table top, but that can also be used with smaller table tops since the drawstring 20 action allows the table cover 10 to be pulled tautly to conform to the size of smaller table tops. The table cover 10 is also easy to use, and is more durable. Production costs are reduced since one size can fit a number of different sizes of table tops.

The table cover 10 of the present invention is especially suited for use with outdoor tables, since the drawstring 20 secures the table cover 10 to the table top and is effective against strong winds and shields the table top from the environment. An opening 42 may be provided in the center of the panel 12 to allow the shaft of an umbrella (not shown) to be inserted therethrough and into an opening in the table top of an outdoor table. Furthermore, the table cover 10 of the present invention may also be used as a table cloth for indoor tables such as dining tables with the drawstring 20 effectively securing the table cover 10 from slippage during use.

Furthermore, although the table cover 10 has been described in connection with circular shapes, it is within the scope of the present invention to provide the table cover 10 in other shapes, such as oval, for use with oval-shaped table tops. Again, a large-sized oval-shaped table cover according to the present invention can be used to cover oval table tops of smaller sizes.

While the description above refers to particular embodiments of the present invention, it will be understood that many modifications may be made without departing from the spirit thereof.

What is claimed is:

1. A table cover for use in covering a table top, comprising:

a panel having a peripheral edge, the panel having a sleeve provided along the peripheral edge, the sleeve having an exposed section and a first opening and a second opening about the exposed section;

a drawstring held within the sleeve and having a first free end extending from the first opening and a second free end extending from the second opening; and a tongue coupled to the panel about the exposed section of the sleeve between the first opening and the second opening, the tongue having a loop provided therethrough;

wherein the first free end of the drawstring passes through the loop in a first direction and the second free end of the drawstring passes through the loop in a second direction opposite the first direction.

2. The table cover of claim 1, wherein the panel has a circular shape.

3. The table cover of claim 1, wherein the panel has an oval shape.

4. The table cover of claim 1, wherein the drawstring comprises a first stopper provided at the first free end and a second stopper provided at the second free end.

5. The table cover of claim 1, wherein the first free end and the second free end of the drawstring are simultaneously pulled taut to conform the panel to the table top.

6. The table cover of claim 5, wherein the first free end and the second free end are tied to secure the panel to the table top.

7. The table cover of claim 1, further comprising an elastic connected to and extending along the peripheral edge, wherein the tongue is connected adjacent the elastic about the exposed section.

8. A method for covering the table top of a table, comprising the steps of:

providing a table cover comprising a panel, the panel comprising a peripheral edge and a sleeve provided along the peripheral edge, the sleeve having an exposed section and a first opening and a second opening about the exposed section, the table cover further comprising a drawstring held within the sleeve and having a first free end extending from the first opening and a second free end extending from the second opening, and the table cover further comprising a tongue attached to the panel about the exposed section of the sleeve between the first opening and the second opening, the tongue having a loop provided therethrough;

passing the first free end of the drawstring through the loop in a first direction;

passing the second free end of the drawstring through the loop in a second direction opposite the first direction;

simultaneously pulling the first free end and the second free end to conform the panel to the table top; and tying the first free end and the second free end to secure the table cover to the table top.

* * * * *